US007097607B2

(12) United States Patent
De Matteis

(10) Patent No.: US 7,097,607 B2
(45) Date of Patent: Aug. 29, 2006

(54) FOLDING ROLLER FOR PAPER CONVERTING MACHINE

(75) Inventor: Alessandro De Matteis, Lucca (IT)

(73) Assignee: MTC—Macchine Trasformazione Carta S.r.l., Lucca (IT)

( * ) Notice: Subject to any disclaimer, the term of this patent is extended or adjusted under 35 U.S.C. 154(b) by 0 days.

(21) Appl. No.: 10/709,189

(22) Filed: Apr. 20, 2004

(65) Prior Publication Data

US 2004/0235633 A1 Nov. 25, 2004

(30) Foreign Application Priority Data

May 15, 2003 (EP) ..... 03425313

(51) Int. Cl.
*B31F 1/10* (2006.01)

(52) U.S. Cl. ..... 493/424; 493/411; 493/430; 493/442; 493/454; 493/344

(58) Field of Classification Search ..... 493/411, 493/424, 430–435, 442, 454, 344; 270/39.05, 270/39.06, 39.01; 492/6, 7
See application file for complete search history.

(56) References Cited

U.S. PATENT DOCUMENTS 3,363,896 A * 1/1968 McKindary ..... 493/418
4,270,744 A * 6/1981 Trogan ..... 493/430
4,472,155 A 9/1984 Greding
4,778,441 A * 10/1988 Couturier ..... 493/425
4,822,328 A * 4/1989 Bertolini et al. ..... 493/425
5,088,707 A * 2/1992 Stemmler ..... 270/39.02
5,147,273 A * 9/1992 Rottmann et al. ..... 493/349
5,310,398 A * 5/1994 Yoneyama ..... 493/430
5,379,961 A 1/1995 Urban et al.
5,730,695 A * 3/1998 Hauschild et al. ..... 493/416
6,165,116 A * 12/2000 White ..... 493/360
6,213,927 B1 * 4/2001 De Matteis et al. ..... 493/360
6,228,014 B1 * 5/2001 De Matteis et al. ..... 493/424
6,299,162 B1 * 10/2001 Ogasawara ..... 271/272

* cited by examiner

*Primary Examiner*—Stephen F. Gerrity
*Assistant Examiner*—Hemant M. Desai
(74) *Attorney, Agent, or Firm*—Simpson & Simpson, PLLC

(57) ABSTRACT

An interfolding machine, having first and second folding counter rotating rollers, a substantially cylindrical body and a plurality of folding means for engaging at a contact line (15) for making a stack of folded and/or interfolded sheets in a folding area. Each folding roller (1) is held by at least one support (10) arranged substantially opposite to the contact line in order to not impede folding operations in the folding area. Between the support and the folding roller, a bearing (20) is mounted that allows free rotation. The support holds the folding roller at an angular portion circumferentially unoccupied by folding elements or mechanical clamps and inclined at an angle with respect to a plane containing the axes of the two rollers. The support does not interfere with the adjusting operation of the folding roller and allows processing of the sheet or web of paper without interrupting continuity.

4 Claims, 4 Drawing Sheets

Fig. 5
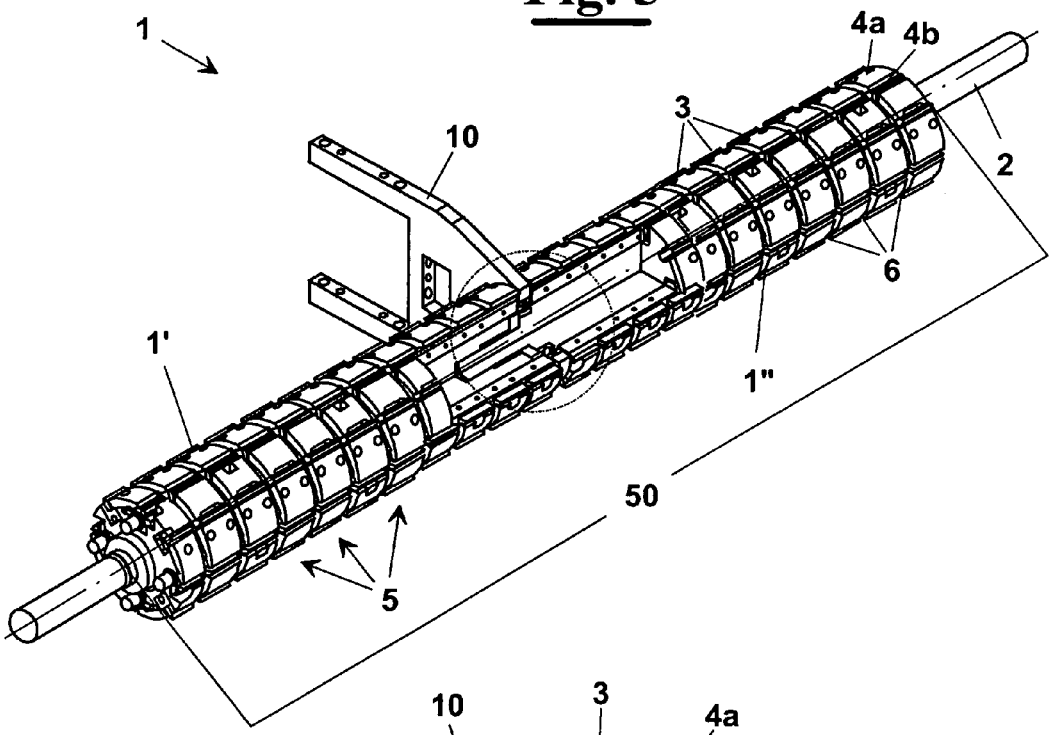
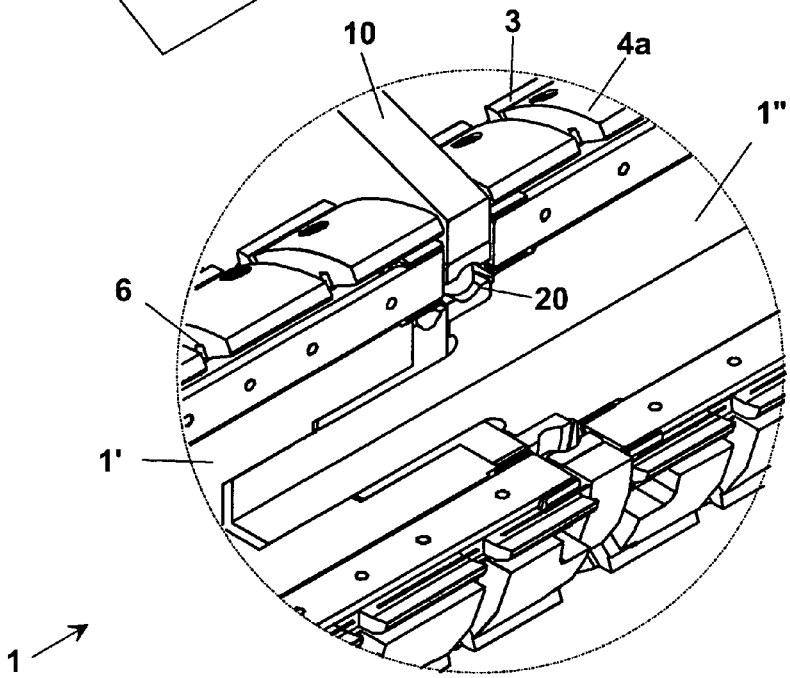
Fig. 6

FOLDING ROLLER FOR PAPER CONVERTING MACHINE

CROSS REFERENCE TO RELATED APPLICATIONS

This non-provisional patent application claims priority under 35 U.S.C. §119 to European Patent Application No. EP03425313.8, which application was filed on May 15, 2003.

FIELD OF THE INVENTION

The present invention relates to the field of converting machines for paper and similar products, and more precisely it relates to a folding roller used in machines for folding or interfolding sheets. Furthermore, the present invention relates to a folding method carried out by this roller.

BACKGROUND OF THE INVENTION

As known, in the paper converting industry a variety of machines and processes are used for making paper napkins, wipers, certain types of toilet paper and other articles in the form of folded and/or interfolded stacks of sheets.

A production process starts from a web having a certain transversal width, from which sheets are obtained, that are folded, stacked continuously and then split into stacks of a same height as the final packages. Each of the stacks is called a log and has the same length as the above described transversal width. The logs, moreover, are cut off and wrapped into many packages with determined final size.

In some cases, the sheets obtained from the web are folded separately from one another and then stacked already folded. In other cases, the sheets are interfolded, namely are folded into panels by overlapping at the same time a panel of a previous sheet with a panel of a following sheet. In this way, when pulling a sheet from the stack, at the moment of the use also a panel of the following sheet is pulled out, with consequent advantages for certain types of uses. Among the possible interfolding ways, stacks of L, Z or W interfolded sheets are known having 2, 3 and 4 panels respectively.

For the production of interfolded stacks, machines are known that use one or two webs of paper coming from a reel that are cut into sheets and then supplied offset with respect to one another on folding counter-rotating rollers.

More precisely, the webs are cut into sheets by means of cutting rollers that engage with respective blades. In case of L or W interfolding, the webs are cut so that they form a sequence of offset sheets coming preferably from two different directions. Therefore, the sheets coming from both directions are supplied alternately to the folding rollers so that each sheet coming from a first direction overlaps a portion of the sheet coming from the second direction, and vice versa.

The sheets coming from both directions, in order to be overlapped in the above described way, adhere to the respective folding rollers by means of a vacuum-suction step or by means of mechanical gripping.

In machines where mechanical clamps hold the paper, special folding rollers 101 are used, as shown diagrammatically in FIGS. 1 and 2. In particular, a folding roller 101 of prior art is circumferentially equipped with a plurality of folding elements 103 alternated to a plurality of mechanical clamps 104. In particular, each mechanical clamp 104 consists of a fixed jaw 104*a* and a movable jaw 104*b* operated by a cam mechanism.

The folding process of the sheets or of the web of paper provides two counter rotating folding rollers that contact along a line where a folding element 103 of one roller forces a sheet or web of paper into a mechanical clamp 104 of the other roller according to a predetermined combination of movements. The alternation of the folding elements 103 and of the mechanical clamps 104 on the boundary of the folding roller 101 causes the sheet or web of processed paper to fold according to different possible configurations.

More in detail, when mechanical clamp 104 is at a first predetermined angular position, movable jaw 104*b* is operated by a cam and pushes against fixed jaw 104*a* the sheet, which engages on the surface of folding roller 101. Then, when then mechanical clamp 104 is at a second predetermined angular position, the cam mechanism opens mechanical clamp 104 releasing the sheet that then leaves roller surface 101.

Therefore, the sheet or web of paper is held on the folding roller in a certain angular portion defined between the above-described angular positions. Then, the downstream end of each sheet leaves its own folding roller at the contact line between the two rollers, adhering to the other folding roller, to which also the upstream end of the previous sheet adheres.

In addition to mechanical sheet holding systems, vacuum holding systems are known where the sheet of paper is caused to adhere to the folding roller surface by a vacuum-suction system. Furthermore, mixed vacuum-mechanical systems are known.

Both in the case of folding rollers with mechanical clamps and of vacuum folding rollers the need is felt for increasing the interfolding sheets' width, obtaining longer logs to cut-off for increasing productivity of the process and for reducing production costs. This would require an increased length of the rollers, which is impossible technically.

In fact, one technical reason is that the diameter of the rollers should also be increased proportionally, but this is impossible because the diameter is strictly given by a determined linear development necessary for interfolding. On the other hand, even maintaining the same diameter, the length of the rollers cannot be increased, since they are already weakened for the presence of circumferential grooves, and during the production process they are already subject to an inevitable bending, which has to be minimum for not damaging the machine and/or the product. Therefore, folding rollers with increased length cannot be made beyond a certain limit, because this causes the roller to bend too much, thus limiting the maximum length of the log at the outlet of the machine, then limiting productivity.

SUMMARY OF THE INVENTION

It is therefore an object of the present invention to provide a folding roller for converting machines of paper or similar products, which allows processing of webs or sheets of increased width without affecting the stability and correct operation of the machines.

It is another object of the invention to provide a roller that allows high production rates.

It is a particular object of the present invention to provide a folding method for converting sheets or webs of paper or similar material into folded and/or interfolded stacks of sheets, carried out by the roller.

These and other objects are achieved by a folding roller, according to the present invention, that can be used in converting machines of paper or similar products, said machines comprising a first and a second counter rotating folding roller having a cylindrical body equipped with a plurality of folding rings alternated to a plurality of grooves, wherein said first and said second folding roller interact at a contact line for making a stack of folded and/or interfolded sheets in a folding area downstream of said contact line, whose main feature is to provide at least one support for said folding roller arranged substantially opposite to said contact line and in order not to impede folding operations in the folding area.

Advantageously, between the support and the respective folding roller a bearing is provided suitable for allowing free rotation of the roller with respect to the support.

In particular, the or each support holds the relative folding roller at a portion not occupied by the folding rings such as a gap between the folding rings and mechanical clamps. This way, the presence of the support does not interfere with the adjusting operation of the folding roller, thus allowing processing of the sheet or web of paper without interruption of continuity. Furthermore, the use of a support does not require special further work with respect to a folding roller of prior art.

A significant advantage deriving from the choice of using a support arranged in a determined point of the folding roller is to control the distribution of the forces on the roller same and then to limit in operative conditions its bending so that the deflection does not exceed a critical value, beyond which the machine or the product would be damaged. In particular, the presence of the support allows providing folding rollers of considerable length and to process, therefore, much wider webs or sheets of paper thus increasing productivity of the machine and flexibility of the same.

Advantageously, each folding roller comprises at least a first and a second cylindrical body operatively connected at an end so that they can rotate integrally. In this case, the support and the relative bearing can be arranged at the operatively connected ends of the two cylindrical bodies. This solution makes easier the assemblage of the bearing and allows obtaining long rollers starting from shorter portions.

According to another aspect of the invention a method to obtain paper products or the like in the form of folded and/or interfolded sheets provides the steps of feeding and moving a sheet or web of paper in a folding and/or interfolding machine up to a couple of folding counter rotating rollers, suitable for cooperating at a contact line for making a stack of interfolded and/or folded sheets in a folding area located downstream of the contact line, whose main feature is that the folding rollers are held by supports substantially opposite to the contact line of each roller without impeding the folding area.

BRIEF DESCRIPTION OF THE DRAWINGS

Further characteristics and the advantages of the folding roller, according to the present invention, will be made clearer with the following description of an embodiment, explicative but not limitative thereof, with reference to the attached drawings wherein:

FIG. 5 shows a perspective view of the folding roller of FIG. 3;

FIG. 6 shows a perspective view of a detail of a section plane of the folding roller of FIG. 5 enhancing the parts thereof; and, FIG. 7 shows diagrammatically the relative position of two folding rollers and of the relative supports.

DETAILED DESCRIPTION OF A PREFERRED EMBODIMENT

Figure 3:
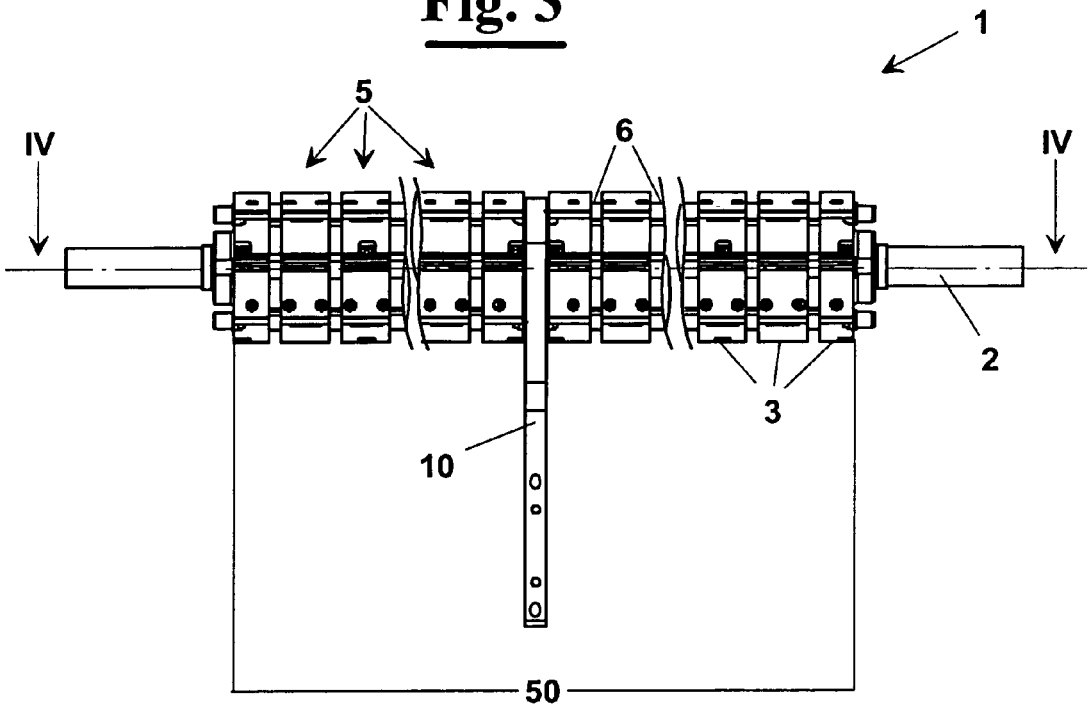
FIG. 3 shows in an elevational side view a possible embodiment of a folding roller, according to the present invention.
Figure 4:
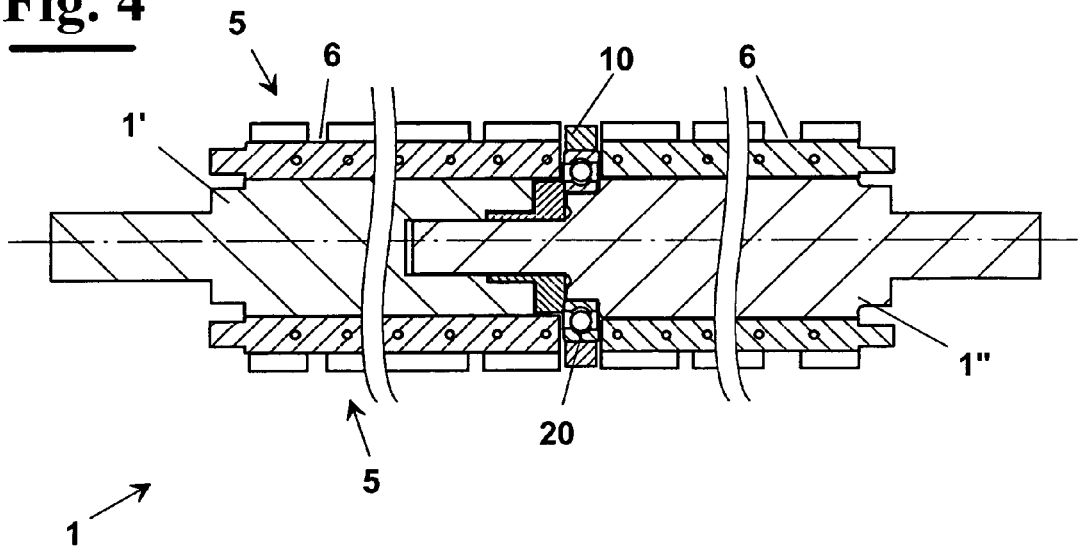
FIG. 4 shows a longitudinal cross section of the folding roller according to arrows III—III FIG. 3.

In FIG. 3 a folding roller 1 is shown in an elevational side view that can be used in converting machines of paper or similar products such as folding or interfolding machines, according to the invention.

Figure 7:
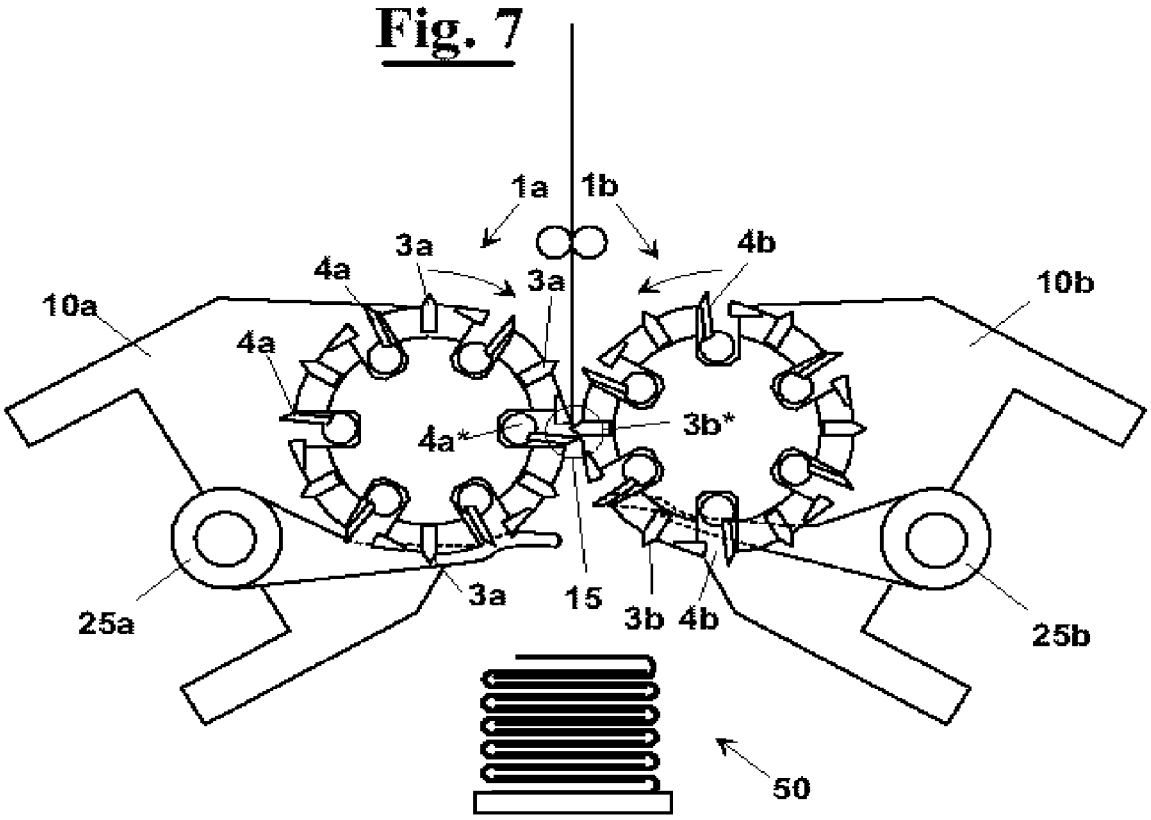

Like a folding roller 101 of mechanical type of prior art, the folding roller of FIG. 3 has a plurality of folding elements 3 arranged in longitudinal rows alternated to a plurality of mechanical clamps 4 formed by a fixed jaw 4*a* and a movable jaw 4*b* to form folding zone 50. Even mechanical clamps 4 are arranged in longitudinal rows and with folding elements 3 form a plurality of folding rings 5 alternated to a plurality of grooves 6. In particular, as diagrammatically shown in FIG. 7, a folding or interfolding machine comprises a first folding roller 1*a* and a second folding roller 1*b*, which are counter rotating; they interact at a contact line 15 and make a stack 50 of folded and/or interfolded sheets in a folding area downstream of the contact line 15. In particular, in the instant shown in FIG. 7 at the contact line 15 a folding element 3*b* of roller 1*b* interacts with a mechanical clamp 4*a* of roller la in order to cause the sheet of paper, not shown, to adhere to the surface of the relative roller. The alternation of folding elements 3 and of mechanical clamps 4 on the boundary of the folding rollers 1 and the presence of folding fingers 25*a* and 25*b* allows stack 50 to form of folded and/or interfolded sheets.

In particular, each folding roller 1*a* or 1*b* is held by at least one support respectively 10*a* or 10*b* arranged substantially opposite to the contact line 15 in order not to impede the operation in the folding area. As shown in FIG. 5, and more in detail in FIG. 6, between support 10 and folding roller 1*a* bearing 20 is mounted that allows a relative rotation.

Figure 1:
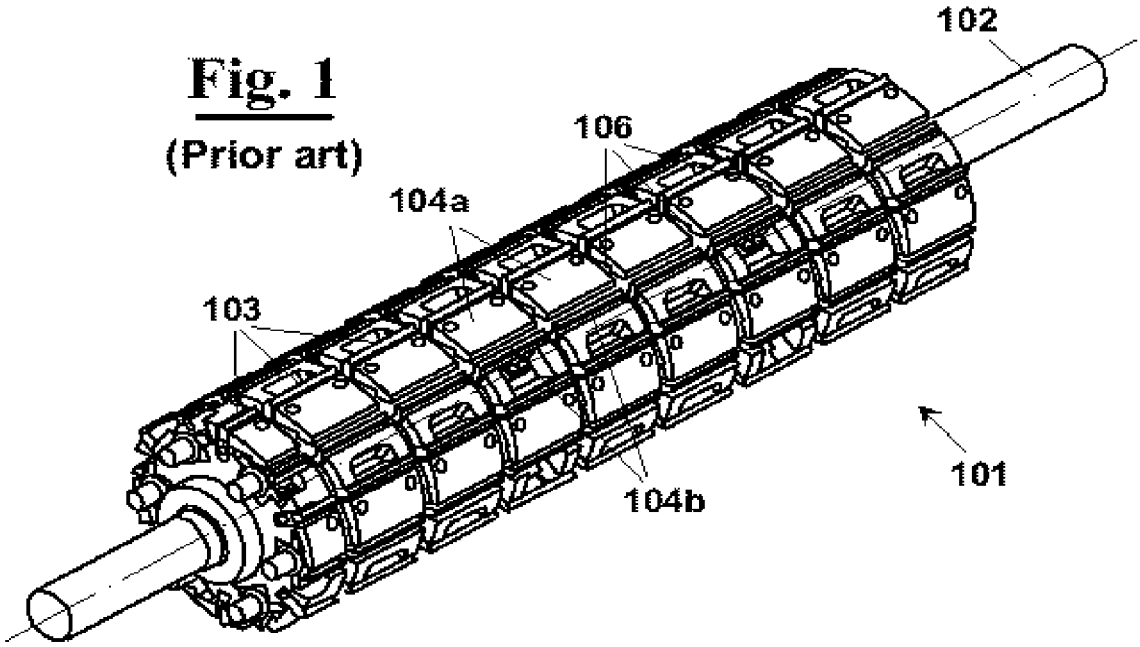
Fig. 1 (Prior art)
FIGS. 1 and 2 show respectively a perspective view and a top plan view of a folding roller with mechanical holding system of prior art.
Figure 2:
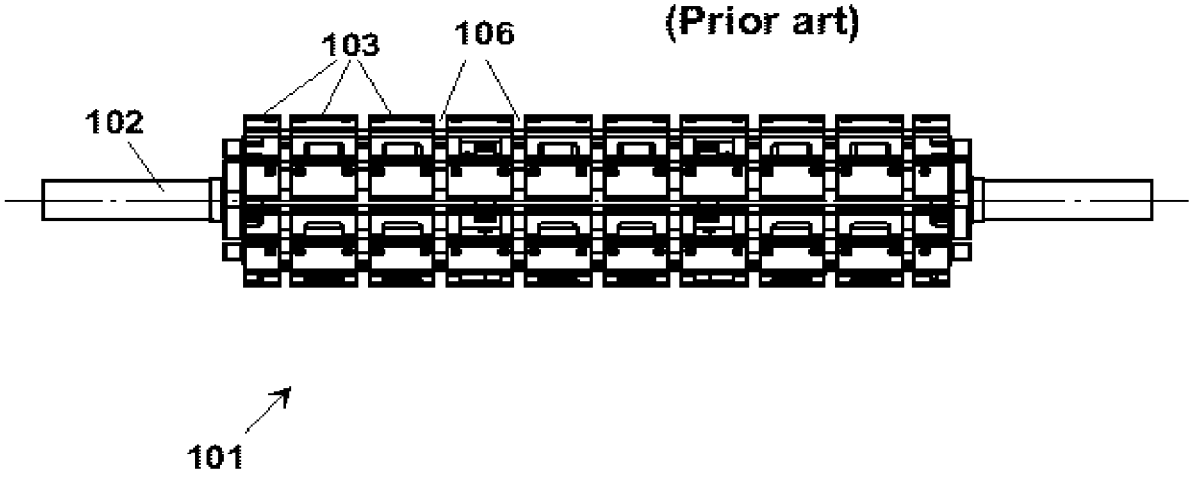
Fig. 2 (Prior art)

It must be noted that support 10 holds folding roller 1 at an angular portion circumferentially not occupied by folding elements 3 and by mechanical clamps 4 (FIG. 6), and that it is inclined at a certain angle with respect to the plane containing the centres of the two rollers. Such an unoccupied portion may be in the form of a gap between folding elements 3 and/or mechanical clamps 4. Such an unoccupied portion may be in the form of a gap between folding elements 3 and/or mechanical clamps 4. This way, the presence of support 10 does not interfere with the adjusting operation of the folding rollers 1*a* and 1*b* and allows processing of the sheet or web of paper without interruption of continuity. Furthermore, the use of a support 10 does not require special further works with respect to a folding roller of prior art 101, as will be apparent comparing, for example, FIG. 1, where a roller 101 of prior art is shown, with FIG. 5, where instead a roller 1 is shown according to the invention. The use of support 10 allows to make folding rollers 1 of considerable length and to process, therefore, webs or sheets of paper of considerable length, thus increasing productivity and flexibility of the machine without affecting the correct operation.

As shown in Figures from 4 to 6, a folding roller 1 can also be made of more parts. For example, it can comprise a first cylindrical body 1' rigidly connected at an end to a second cylindrical body 1" so that, in operative conditions, they can rotate integrally. In this case, support 10 and the relative bearing 20 can be arranged advantageously at the connection region of the two cylindrical bodies.

Notwithstanding reference has been made to mechanical folding rollers, it is not excluded that the invention is applied to folding rollers having a vacuum suction system and/or folding rollers surface with mixed vacuum-mechanical systems.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. A pair of counter rotating folding rollers for use in machines for converting paper or similar products, each of said pair of counter rotating folding rollers comprising at least one substantially cylindrical body having longitudinal axis and a plurality of folding means, wherein said pair of folding rollers interact at a contact line to produce a stack of folded and/or interfolded sheets downstream from said contact line characterised in that at least one support spaced from said contact line and extending transversely from the longitudinal axis is provided for each of said pair of folding rollers in order not to impede folding operations in said folding area and wherein each of said pair of counter rotating folding rollers further comprises a gap for contacting said at least one support wherein said gap is located at the end of or between said plurality of folding means.

2. The pair of counter rotating folding rollers according to claim 1, wherein between said at least one support and said supported folding roller a bearing is provided suitable for allowing a free rotation of said supported folding roller with respect to said at least one support.

3. The pair of counter rotating folding rollers according to claim 1, wherein said each of said pair of counter rotating folding rollers comprises at least a first and a second cylindrical body wherein one end of each of said first and second cylindrical bodies are coaxial to each other and operatively connected to each other along the cylindrical axes of said first and second cylindrical bodies so that they can rotate integrally.

4. The pair of counter rotating folding rollers according to claim 3, wherein at least one of said at least one support for each of said pair of folding rollers further comprises a relative bearing arranged to contact said folding roller at said operatively connected ends.

* * * * *